United States Patent [19]

Kagami et al.

[11] Patent Number: 4,510,191

[45] Date of Patent: Apr. 9, 1985

[54] CASTING NOZZLE

[75] Inventors: Toshiro Kagami, Kanagawa; Kuniaki Watanabe, Tokyo, both of Japan

[73] Assignee: Toshiba Ceramics Co., Ltd., Tokyo, Japan

[21] Appl. No.: 429,014

[22] Filed: Sep. 30, 1982

[51] Int. Cl.[3] ..... B22D 0/1

[52] U.S. Cl. ..... 428/36; 264/60; 264/63; 164/349

[58] Field of Search ..... 428/35, 36, 131; 164/349; 264/60, 63

[56] References Cited

FOREIGN PATENT DOCUMENTS 47-49409 12/1972 Japan .

*Primary Examiner*—George F. Lesmes

*Assistant Examiner*—Nancy A. B. Swisher

*Attorney, Agent, or Firm*—Oblon, Fisher, Spivak, McClelland & Maier

[57] ABSTRACT

A casting nozzle for molten steel with improved spalling resistance and corrosion resistance is prepared by kneading a raw material consisting of 42 to 93% by weight of an alumina simple substance powder, 4 to 44% of a graphite simple substance powder and 10 to 27% by weight of a fused silica simple substance powder after adding a binder thereto, pelletizing the resultant mixture, pressing the pellets with a rubber press, and sintering the pressed nozzle at a low temperature within a range such that the resultant nozzle may have the characteristics attributable to the addition of alumina, graphite and fused silica.

6 Claims, 2 Drawing Figures

FIG. 1
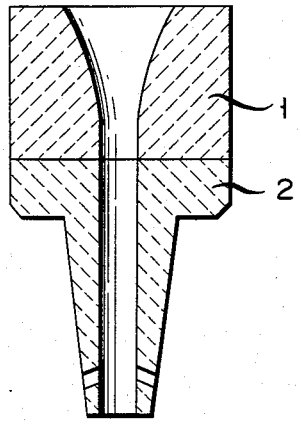
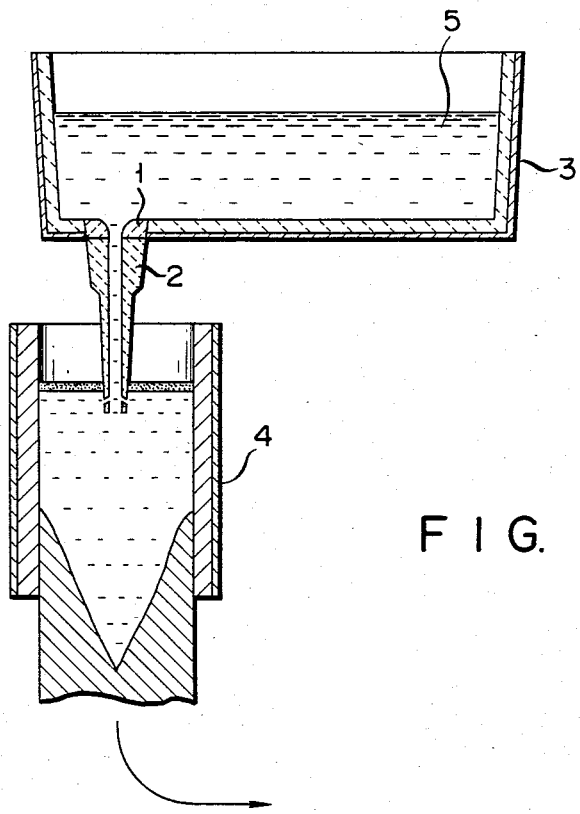
FIG. 2

CASTING NOZZLE

BACKGROUND OF THE INVENTION (1) Field of the Invention

The present invention relates to a casting nozzle and, more particularly, to a nozzle which is mounted at the lower part of a ladle or tundish so as to guide molten steel into a mold for continuously casting steel.

(2) Description of the Prior Art

A casting nozzle used for casting molten steel is used in severe conditions of high temperatures. Various studies have been made on refractories for the casting nozzle. A tundish nozzle for guiding molten steel from a tundish to a mold for continuous casting of steel is considered to be one of the most important devices used in continuous casting. The casting nozzle which communicates the tundish with the mold must have good heat insulating characteristics and must be able to prevent oxidation of molten steel, turbulent flow of molten steel, or the mixing in of a slag. The nozzle must also be durable, and so, economical.

Alumina-graphite based, zirconia-based or zircon-based casting nozzles are conventionally known. However, each one of these nozzles has both advantages and disadvantages and is not wholly satisfactory.

An alumina-graphite based-casting nozzle contains clay as a binder and is thus less resistant to thermal shock, relatively fragile, and inferior in corrosion resistance. Especially in the case of an immerging nozzle, significant corrosion takes place upon contact with molten steel, which results in erosion or enlargement of the nozzle diameter. Although a zirconia- or zircon-based casting nozzle is resistant to erosion, it is subject to deposition thereon of metals especially aluminum and oxides of aluminum in the molten steel. This causes reduction in the nozzle diameter during casting and may finally result in closure of the nozzle.

An immerged nozzle of fused quartz has also been recently developed. If such an immerged nozzle of fused quartz is used to cast molten steel which contains 1.2 to 1.5% manganese, it is subject to significant melting loss.

In view of this, the present inventors previously proposed a continuous casting nozzle which is prepared by sufficiently kneading with a binder 42 to 93% by weight of alumina power, 4 to 44% graphite powder, and 2 to 23% silica powder, and pressing the resultant mixture with a rubber press. A patent application for claiming the right on this continuous casting nozzle was published on Dec. 12, 1972 and was granted a patent on May 13, 1979 as Japanese Pat. No. 955,778.

This continuous casting nozzle has corrosion resistance, erosion resistance, clogging resistance and spalling resistance which are superior to those of the conventional casting nozzles. However, the patent as mentioned above teaches the use of a silica powder such as amorphous silica or quartz powder as a raw material. Although this patent also suggests the use of fused silica, 5% by weight of fused silica is used. This patent does not limit the sintering temperature of the pressed casting nozzle. However, according to further studies made by the present invention, if a fused silica powder which has a small coefficient of thermal expansion and a small coefficient of thermal conductivity is used, the resultant casting nozzle is superior in heat resistance and spalling resistance to casting nozzles using other silicas. Good results are obtained if at least 10% of such a fused silica is used and if the sintering temperature of the pressed casting nozzle is between 800° and 1,200° C.

SUMMARY OF THE INVENTION

It is the first object of the present invention to provide a casting nozzle which has corrosion resistance, resistance to erosion, resistance to closure, and spalling resistance.

It is the second object of the present invention to provide a casting nozzle which is prepared from a raw material consisting of an alumina simple substance powder, a carbon simple substance powder, and a fused silica simple substance powder.

It is the third object of the present invention to provide a casting nozzle which is obtained by sintering the pressed casting nozzle in a low temperature range of 800° to 1,200° C. in which alumina and silica will not react with each other and will not have their metallurgical structures changed.

It is the fourth object of the present invention to provide a casting nozzle which is prepared by pressing with a rubber press.

In order to achieve the above objects of the present invention, there is provided a casting nozzle which is prepared by sufficiently kneading a raw material consisting of 42 to 93% by weight of an alumina simple substance powder, 4 to 44% by weight of a graphite simple substance powder, and 10 to 27% by weight of a fused silica simple substance powder after adding an organic binder; pelletizing the resultant mixture; pressing the resultant pellets and releasing the rubber pressed casting nozzle; and sintering the pressed casting nozzle at 800° to 1,200° C. after drying.

According to an aspect of the present invention, a phenol resin is used as the organic binder.

According to another aspect of the present invention, tar pitch is used as the organic binder.

According to still another aspect of the present invention, the mean size of the pellets is 1 mm or less.

BRIEF DESCRIPTION OF THE DRAWINGS

FIG. 1 is a sectional view of a immerged casting nozzle according to an embodiment of the present invention, which is connected to a tundish nozzle; and FIG. 2 is a sectional view of a state wherein molten steel is casted into a mold by a tundish to which the nozzle according to the embodiment of the present invention is mounted.

DETAILED DESCRIPTION OF THE PREFERRED EMBODIMENT

The preferred embodiment of the present invention will be described. The starting material of the present invention is a raw material powder consisting of 42 to 93% by weight of an alumina simple substance powder, 4 to 44% by weight of a graphite simple substance powder, and 10 to 27% by weight of a fused silica simple substance powder. An organic binder is added in the amount of about 5% by weight to the starting material based on 100% by weight thereof. The resultant mixture is sufficiently kneaded. The binder to be used herein is tar pitch or a synthetic resin: preferably a phenol resin if a thermosetting resin is used and polyvinyl alcohol if a thermoplastic resin is used. If the amount of the alumina powder is less than 42% by weight, corrosion resistance obtained by the addition of alumina is impaired. This results in enlargement of the nozzle diameter or erosion. On the other hand, if the amount of the alumina powder is more than 93% by weight, alumina reacts with the molten steel and other metals such as manganese or aluminum to form a denatured layer on the nozzle inner surface and cause separation. If alumina is contained in such a large amount, the spalling resistance is degraded. If the amount of the graphite powder is less than 4% by weight, the effect obtained by addition of the graphite powder, that is, improvements in resistance to separation of the inner surface of the nozzle or spalling resistance may not be obtained. On the other hand, if the amount of the graphite powder is more than 44% by weight, the amount of graphite which is diffused into the molten steel increases, the coefficient of thermal conductivity is increased, and the nozzle tends to be closed with decreases in the temperature of the molten steel. Since alumina and graphite alone cannot completely prevent closure of the nozzle and cannot provide satisfactory spalling resistance, fused silica is further added according to the present invention. The effect of addition of fused silica is not obtained if the amount of molten silica is less than 10% by weight. On the other hand, if the amount of fused silica is more than 27% by weight, the corrosion resistance is impaired.

The kneaded starting material as described above is pelletized with a milling machine. The mean size of the pellets is preferably 1 mm or less. The pellets thus obtained are placed in a rubber mold which is, in turn, mounted on a rubber press for pressing. According to the present invention, since pressing is performed by rubber pressing, the overall casting nozzle of an elongate material may have a uniform density and may not have cracks or pores therein. If conventional molding is used in place of rubber pressing, the kneaded material is pressed in a steel or wooden mold of a given shape. For this reason, with elongate casting nozzles of miscellaneous shapes, the core parts may have smaller densities and may be subject to cracking and/or formation of pores. Thus, the bulk density tends to increase toward the periphery (radial direction) of the nozzle. These drawbacks are prevented by pelletizing and rubber pressing according to the present invention.

The pressed material is released from the mold and is sintered at a sintering temperature of 800° to 1,200° C. If the sintering temperature is lower than 800° C., the mechanical strength of the sintered body is unsatisfactory and may be subject to bending or the like during casting. On the other hand, if the sintering temperature is higher than 1,200° C., the fused silica particles start reacting with the alumina particles and come to have a different metallurgical structure, and the individual characteristics of alumina, carbon and fused silica are lost and the effect of addition of these three materials is thus lost. As a result of this, the corrosion resistance and spalling resistance are impaired. When the pressed nozzle is sintered at a temperature higher than 1,200° C., sintering progresses too far and the nozzles will produce a metallic sound when being tapped, and defective nozzles will be produced at a rate of 10 out of every 100 pressed nozzles. This is not commercially advantageous. The sintering temperature should be preferably kept within the range of 900° to 1,100° C.

According to the present invention, powders of alumina, carbon and fused silica are used in the forms of simple substances and are pressed with a rubber press into a uniform and dense pressed nozzle. The individual characteristics of alumina, carbon and fused silica are retained in the resultant casting nozzle if the nozzle is sintered within the low temperature range mentioned above.

Referring to FIG. 1, reference numeral 1 denotes a tundish nozzle, and reference numeral 2 denotes a immerged nozzle connected thereto. FIG. 2 shows a state wherein a molten steel 5 is cast into a mold 4 from a tundish 3 which is placed above the mold 4 and which has the tundish nozzle 1 and the immerged nozzle 2. The molten steel 5 is cast into the mold 4 from the tundish 3 through the immerged nozzle 2 whose distal end is immerged in the molten steel. The molten steel is then cooled and solidified and is pulled downward continuously. Since this semisolidified steel is still soft to allow bending, it is guided by a number of rolls (not shown) to be bent to have a small radius of curvature, is conveyed in the direction indicated by an arrow and is cut at a predetermined position.

The present invention will become more apparent from the following description of examples.

EXAMPLE 1

To 47 parts by weight (to be referred to as parts for brevity unless otherwise indicated) of an alumina simple substance powder were added 28 parts of a graphite simple substance powder, 25 parts of a fused silica simple substance powder, and 3 parts of green tar pitch. These powders were sufficiently kneaded. The kneaded material was pelletized with a speed mill into pellets having a mean size of 1 mm. The pellets were filled into a rubber mold for a casting nozzle. The rubber mold was mounted in a rubber press using glycerin as a liquid. The pressure was raised to 1,200 kg/cm$^2$ in about 5 minutes. The rubber mold was removed from the press and the pressed casting nozzle was released from the mold. The nozzle was sintered at 800° C.

EXAMPLE 2

To a mixture of 45 parts of an alumina simple substance powder were added 40 parts of a natural graphite simple substance powder, 15 parts of a fused silica simple substance powder, and 5 parts of a phenol resin. The resultant mixture was kneaded and was pelletized into pellets having a mean size of about 1 mm with a speed mill similar to that used in Example 1. The pellets were filled into a rubber mold for a casting nozzle, and the rubber mold was mounted on a rubber press similar to that used in Example 1. The pressure was raised to 1,000 kg/cm$^2$ in about 15 minutes. The rubber mold was removed from the press, and the pressed casting nozzle was released from the mold. The casting nozzle was sintered at 1,000° C.

EXAMPLE 3

To a mixture of 63 parts of an alumina simple substance powder were added 27 parts of a graphite simple substance powder, 10 parts of a fused silica simple substance powder, and 2 parts of polyvinyl alcohol. The resulant mixture was sufficiently kneaded. The kneaded material was pelletized into pellets having a mean size of 0.5 mm with a speed mill similar to that used in Example 1. The pellets were filled into a rubber mold for a casting nozzle, and the rubber mold was mounted on a rubber press similar to that used in Example 1. The pressure was raised to 1,500 kg/cm$^2$ in about 20 minutes. The rubber mold was removed from the press, and the pressed casting nozzle was released from the mold. The pressed casting nozzle was sintered at 1,200° C.

The characteristics of the casting nozzles obtained in Examples 1, 2 and 3 above were as shown in the table below:

TABLE

| | Bulk Density | Porosity (%) | Bending strength ($kg/cm^2$) |
|---|---|---|---|
| Example 1 | 2.28 | 15.8 | 320 |
| Example 2 | 2.31 | 16.0 | 300 |
| Example 3 | 2.30 | 22.1 | 270 |

The casting nozzles of the present invention have uniform and dense structures and do not have cracks or pores.

If a casting nozzle prepared in Example 1, 2 or 3 is used as a tundish nozzle, more than several hundred tons of steel may be cast. In contrast to this, a conventional alumina-carbon-based casting nozzle using a clay binder is capable of casting only several tens of tons of steel.

What we claim is:

1. A casting nozzle prepared by kneading a raw material consisting of 42 to 86% by weight of an alumina powder, 4 to 44% by weight of a graphite powder and 10 to 27% by weight of a fused silica powder after addition of a binder to said powder components; pelletizing the resultant mixture; rubber pressing the resultant pellets and releasing a pressed casting nozzle from said rubber press; and sintering the pressed casting nozzle at 800° to 1,100° C. after drying.

2. The casting nozzle according to claim 1, wherein the binder is a phenol resin.

3. The casting nozzle according to claim 1, wherein the binder is tar pitch.

4. The casting nozzle according to claim 1, wherein the binder is polyvinyl alcohol.

5. The casting nozzle according to claim 1, wherein a mean size of the pellets is not more than 1 mm.

6. The casting nozzle according to claim 1, wherein a sintering temperature is 900° to 1,100° C.

* * * * *